US005161316A

United States Patent [19]

Saito

[11] Patent Number: 5,161,316

[45] Date of Patent: Nov. 10, 1992

[54] SECTIONAL TYPE IRONING BOARD, AS WELL AS IRONING TABLE AND PRESSING APPARATUS USING SAID IRONING BOARD

[76] Inventor: Sorai Saito, 177-1, Sengen-cho 3-chome, Nishi-ku, Yokohama-shi, Kanagawa-ken, Japan

[21] Appl. No.: 698,620

[22] Filed: May 10, 1991

[30] Foreign Application Priority Data

May 15, 1990 [JP] Japan ..... 2-49907[U]

[51] Int. Cl.[5] ..... D06F 71/00; D06F 81/02

[52] U.S. Cl. ..... 38/36; 38/106; 38/135; 38/138

[58] Field of Search ..... 38/1 A, 36, 103, 104, 38/106, 107, 135, 136, 139, 140, 138; 223/74

[56] References Cited

U.S. PATENT DOCUMENTS

| | | | |
|---|---|---|---|
| 912,319 | 2/1909 | Nelson | 38/135 X |
| 2,209,370 | 7/1940 | Woodin | 108/13 |
| 2,523,425 | 9/1950 | Gargaglione | 108/13 |
| 2,544,446 | 5/1951 | Nestor | 38/107 X |
| 2,652,646 | 9/1953 | Cave | 38/136 |
| 2,955,370 | 10/1960 | Tipping | 38/135 |
| 3,698,110 | 10/1972 | Shettel | 38/107 |
| 4,779,365 | 10/1988 | Theeton | 38/136 X |
| 4,903,421 | 2/1990 | Saito | 38/137 |
| 5,014,453 | 5/1991 | Gratsch | 38/36 |

FOREIGN PATENT DOCUMENTS

| | | | |
|---|---|---|---|
| 0277441 | 8/1988 | European Pat. Off. . | |
| 0279924 | 8/1988 | European Pat. Off. | 38/103 |
| 96249 | 6/1897 | Fed. Rep. of Germany . | |
| 0810180 | 7/1949 | Fed. Rep. of Germany | 38/106 |
| 3024194 | 1/1982 | Fed. Rep. of Germany | 38/104 |
| 8308205 | 7/1984 | Fed. Rep. of Germany . | |
| 3744148 | 7/1989 | Fed. Rep. of Germany | 38/103 |
| 2458621 | 2/1981 | France . | |
| 2-1100 | 1/1990 | Japan . | |
| 2-12399 | 1/1990 | Japan . | |
| 2-17598 | 5/1990 | Japan . | |
| WO87/07661 | 12/1987 | World Int. Prop. O. . | |

OTHER PUBLICATIONS

*Abstract only.

*Primary Examiner*—Werner H. Schroeder
*Assistant Examiner*—Ismael Izaguirre
*Attorney, Agent, or Firm*—Frishauf, Holtz, Goodman & Woodward

[57] ABSTRACT

A sectional-type ironing board in which a longitudinal direction of a first ironing board and a longitudinal direction of a second ironing board having a working surface smaller than that of the first ironing board are oriented in the same direction, the first and second ironing boards are arranged in such a manner that side edges thereof are mutually adjacent, and the first and second ironing boards are independently movable to a collapsed state and an extended state relative to a common base. The first and second ironing boards are placed in the collapsed state or the extended state to form a joint working surface in the same plane, and the joint working surface is formed by a curved surface extending downwardly to edge portions from a central region along the longitudinal direction. An ironing table is used along with the sectional-type ironing board and includes a cart having a plate formed to have a portion on which the base portion of the sectional-type ironing board is placed and secured. A pressing apparatus employs the joint working surface of the sectional-type ironing board as a pressing board.

20 Claims, 6 Drawing Sheets

SECTIONAL TYPE IRONING BOARD, AS WELL AS IRONING TABLE AND PRESSING APPARATUS USING SAID IRONING BOARD

BACKGROUND OF THE INVENTION

1. Technical Field

This invention relates to a sectional-type ironing as well as to an ironing table and a pressing apparatus which use the sectional-type ironing board.

2. Background Art

In order to facilitate the ironing of small, cylindrically shaped garment portions such as the sleeves of a garment or a child's trousers, a small-size ironing board is available in the prior art. The ironing board has a small width that allows it to be inserted into the cylindrical portion and is adapted so that it can be moved up and down freely relative to a base.

The present applicant has proposed an ironing board in Japanese Utility Model Application Laid-Open (KOKAI) No. 2-12399, in which the aforementioned small-size ironing board having a small width is integrally provided on an ironing board having a large width and is capable of being separated from the larger ironing board.

Thus, the trouble involved in separately preparing a small-size ironing board and an ordinary ironing board is eliminated. In addition, the ironing board can be used for cylindrical garment portions having a small diameter, such as sleeves and children's trousers, and for shoulder portions as well. The ironing board also occupies a small space.

The present applicant has made a further proposal in Japanese Utility Model Application No. 63-76452 (U.S. Pat. No. 4,903,421), in which the working surface of an ironing board on which an iron acts is curved or rounded to reduce the force needed to operate the iron, and is formed to have a large number of projections the spaces between which are filled with steam so that the steam will be capable of acting upon a garment more efficiently. In addition, the base portion of the ironing board is capable of being formed using a resin material.

However, though the ironing board disclosed in the aforementioned Japanese Utility Model Application Laid-Open No. 2-12399 is convenient in that a small-size ironing board used for garment sleeves or the like can be integrated with an ordinary ironing board, the working surface acted upon by the iron is flat, and therefore a problem encountered is that the force required for manipulating the iron is the same as in the conventional flat ironing board.

On the other hand, the ironing board disclosed in the aforementioned Japanese Utility Model Application No. 63-76452 (U.S. Pat. No. 4,903,421) has its working surface provided with the multiplicity of projections, and the base portion of the ironing board, which consists of a resin material, is capable of being molded and made light in weight to make the board easier to handle. In addition, the working surface is made curved so that the force needed for operating the iron can be reduced. However, a problem which arises is that a small cylindrical portion, such as the sleeve of a garment or the leg of a child's trousers, cannot be fitted onto the ironing board and then ironed.

Furthermore, in a conventional pressing apparatus, a flat pressing head which acts upon a flat ironing board is supported so as to rotate freely, by way of example. One problem which arises is that a garment placed upon the flat ironing board moves when it is contacted by the flat pressing head. Another problem is that a garment tends to wrinkle since it is not pressed evenly and uniformly when contacted by the pressing head.

SUMMARY OF THE INVENTION

Accordingly, an object of the present invention is to provide a sectional-type ironing board which takes the foregoing problems into consideration, wherein when the sectional-type ironing board is in a collapsed state or a first ironing board and second ironing board are both in an upstanding state, the ironing of a comparatively broad portion of a garment, such as the back of the garment, is performed using the sectional-type ironing board, whereas when a cylindrical body having a small diameter, such as a sleeve or a child's trousers is to be ironed, only the second ironing board is extended to perform ironing.

In a case where the shoulder portion, etc., of a garment is to be ironed, the second ironing board is placed in a collapsed state, the first ironing board is extended, the shoulder portion is fitted over the first ironing board and the shoulder portion is ironed. Since the working surface of the ironing board upon which the iron acts is curved, the area of surface contact between the working surface and the flat bottom surface of the iron is reduced. As a result, the force needed to manipulate the iron is reduced, the ironing operation can be improved, and ironing can be carried out even when a garment sleeve or the like is fitted over the ironing board.

A second object of the present invention is to provide a sectional-type ironing board in which the working surface of the board is provided with a large number of projections so that steam is capable of acting upon a garment sufficiently.

A third object of the present invention is to provide a sectional-type ironing board in which either the first or second ironing board or both can be formed of a resin material to reduce weight and improve handling.

A fourth object of the present invention is to provide an ironing table in which a sectional-type ironing board is detachably provided on a plate so that the ironing operation can be improved and the table can be used for operations other than ironing.

A fifth object of the present invention is to provide a pressing apparatus equipped with a presser head having a curved surface that matches the curved working surface of a sectional-type ironing board, wherein a garment placed upon the ironing board will not move when contacted by the pressing head, wrinkling of the garment is prevented by arranging it so that the garment will be pressed evenly when contacted by the pressing head, and a cylindrical portion such as a sleeve is capable of being contacted by the heater after this portion is fitted over the ironing board.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENTS

An embodiment of a sectional-type ironing board according to the present invention will now be described with reference to the drawings.

Figure 1:
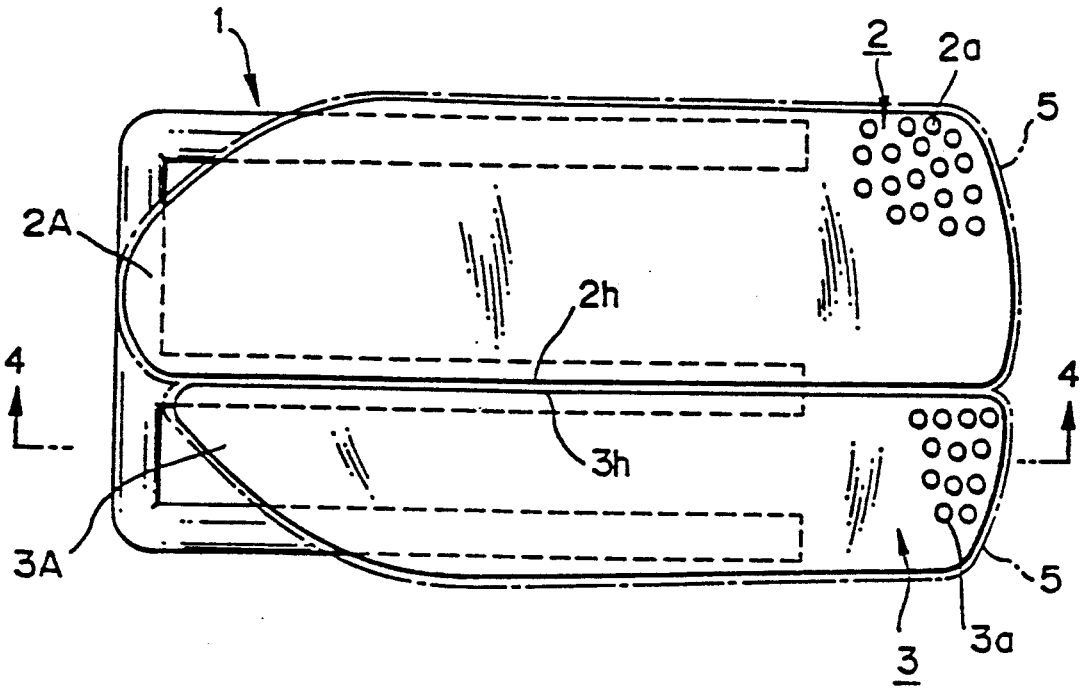
FIG. 1 is a plan view illustrating a sectional-type ironing board according to an embodiment of the present invention.

FIG. 1 is a plan view illustrating a sectional-type ironing board according to an embodiment of the present invention. As shown in FIG. 1, the sectional-type ironing board of the embodiment includes a first ironing board 2 formed so that one side thereof is slanted in order that the board can be inserted into a garment shoulder portion or the like, and an oblong second ironing board 3 adapted to that it can be inserted into a cylindrically shaped garment portion of small diameter, such as a garment sleeve or child's trousers. The first and second ironing boards 2, 3 are provided on a base 1, which is made of iron pipes formed into an E-shaped configuration, so as to be capable of being moved parallel to the base, as will be described later.

The first ironing board 2 and second ironing board 3 are covered individually by covers 5 indicated by the two-dot chain lines in FIG. 1. The arrangement is such that when the first ironing board 2 and second ironing board 3 have been set at the same height, as will be described later, the two boards in combination are capable of functioning as a single ironing board.

The working surfaces of the first and second ironing boards 2, 3 are respectively provided with large members of projections 2*a*, 3*a*, which extend over substantially the entirety of each surface. The valleys between these projections 2*a*, 3*a* become filled with steam produced by a steam iron so that the steam is capable of acting upon a garment in an adequate manner. In addition, the projections 2*a*, 3*a* function as heat radiating bodies so that either or both of the first and second ironing boards 2, 3 can be constructed using a resin material which lacks resistance to heat.

In particular, it is possible to adopt molding which relies upon a thermoplastic resin (e.g., a polypropylene resin or the like) employed in blow molding, thus enabling the ironing boards to be formed as hollow bodies that are light in weight. Furthermore, the first ironing board 2 and second ironing board 3 are juxtaposed in such a manner that the minimum necessary gap is provided between their respective edges 2*h*, 3*h*, as illustrated in FIG. 1. The arrangement is such that when the two ironing boards are used jointly to form a single ironing board, the two edges 2*h*, 3*h* will be flush. In addition, it is so arranged that the first ironing board 2 and second ironing board 3 undergo translational motion.

Figure 2:
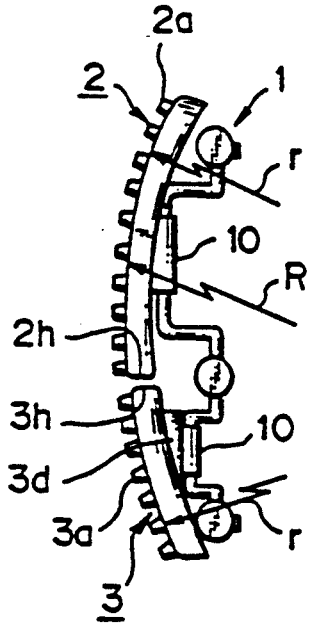
FIG. 2 is a right-side view of the sectional-type ironing board shown in FIG. 1.
Figure 3:
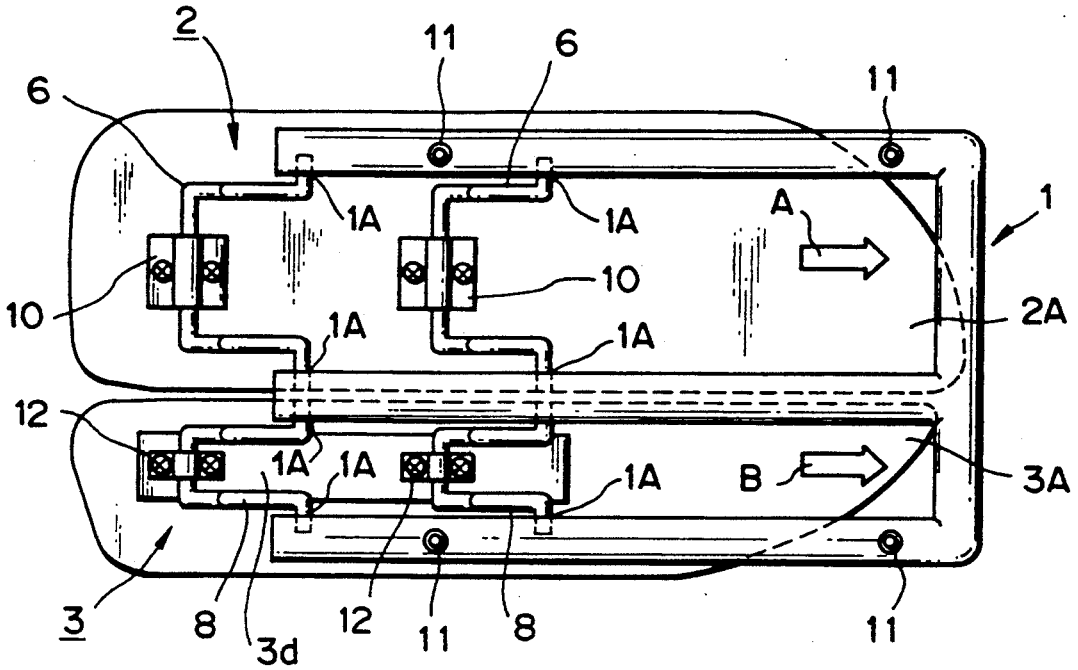
FIG. 3 is a back view of the ironing board shown in FIG. 1.

FIG. 2 is a right-side view of the separating-type ironing board shown in FIG. 1, and FIG. 3 is a back view of the ironing board shown in FIG. 1. Both of these diagrams illustrate the first ironing board 2 and the second ironing board 3 in the collapsed state. First, with reference to FIG. 2, when a joint working surface acted upon by an iron is formed with the first and second ironing boards 2, 3 in the collapsed state or an extended state, a curved surface of radius R, for example, is formed from the central region, which extends in the longitudinal direction of the joint working surface, to the edge portions, and a curved surface of radius r is formed near the edge on the outer side. Thus, the contour of the joint working surface approximates the contour of the torso of the human body.

The joint working surface is provided with the aforementioned multiplicity of projections 2*a*, 3*a*. The projections 2*a*, 3*a* are covered with a thick layer of felt (not shown) and the above-mentioned covers 5.

Next, as shown in FIG. 3, the base 1, which is made of iron pipes formed into a generally E-shaped configuration, is provided with a total of eight turning holes 1A. Both ends of a pair of small support rods 8 which support the second ironing board 3 so that it is capable of translational motion are inserted into the corresponding turning holes IA to axially support these support rods so that they are free to turn. Similarly, both ends of a pair of large support rods 6 which support the first ironing board 3 so that it is capable of translational motion are inserted into the corresponding turning holes 1A to axially support these support rods so that they are free to turn. Thus, the second ironing board 2 and third ironing board 3 are capable of being extended and collapsed independently, as will be described later.

A total of four rubber legs 11 are provided on the bottom face of the base 1 to prevent sliding on a table. In addition, the legs 11 can be set in corresponding holes 24*a* of a table 24 provided on an ironing table, described below.

Since the first ironing board 2 and second ironing board 3 are similarly constructed and so adapted as be capable of translational motion in a similar manner, the construction and operation of the second ironing board 2 will be described as being typical of both ironing boards. The second ironing board 3 has a base portion 3*d* which lies parallel to the base 1. A pair of turning fixtures 12 for axially supporting the central portions of the pair of small support rods 8 so that these support rods are free to turn are attached to the base portion 3*d* by screws. A sheet of felt is attached to the top of the working surface of the second ironing board 3 so as to be enveloped by the cover 5. Thus is formed the working surface of the second ironing board 3.

Figure 4:
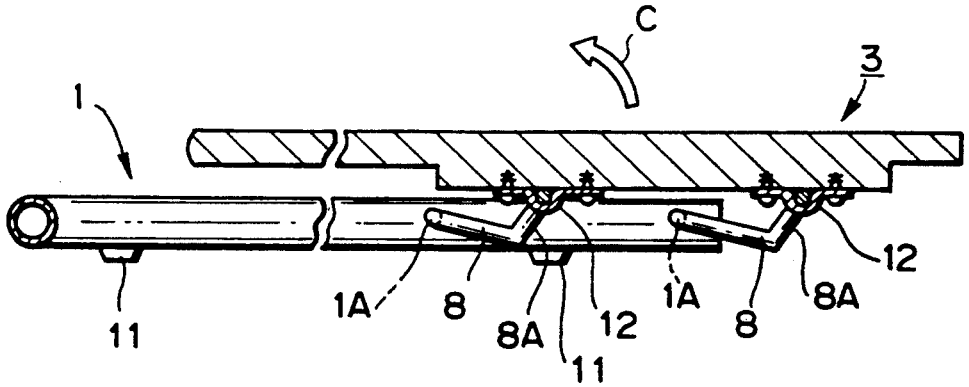
FIG. 4 is a sectional view taken along line 4—4 of FIG. 1.

With reference also to FIG. 4, which is a sectional view taken along line 4—4 of FIG. 1, each of the pair of small support arms 8*a* is formed to have a step portion 8A. When the second ironing board 3 is placed in the extended state, the second ironing board 3 is supported in such a manner that its bottom face rides upon these step portions 8A.

Figure 5:
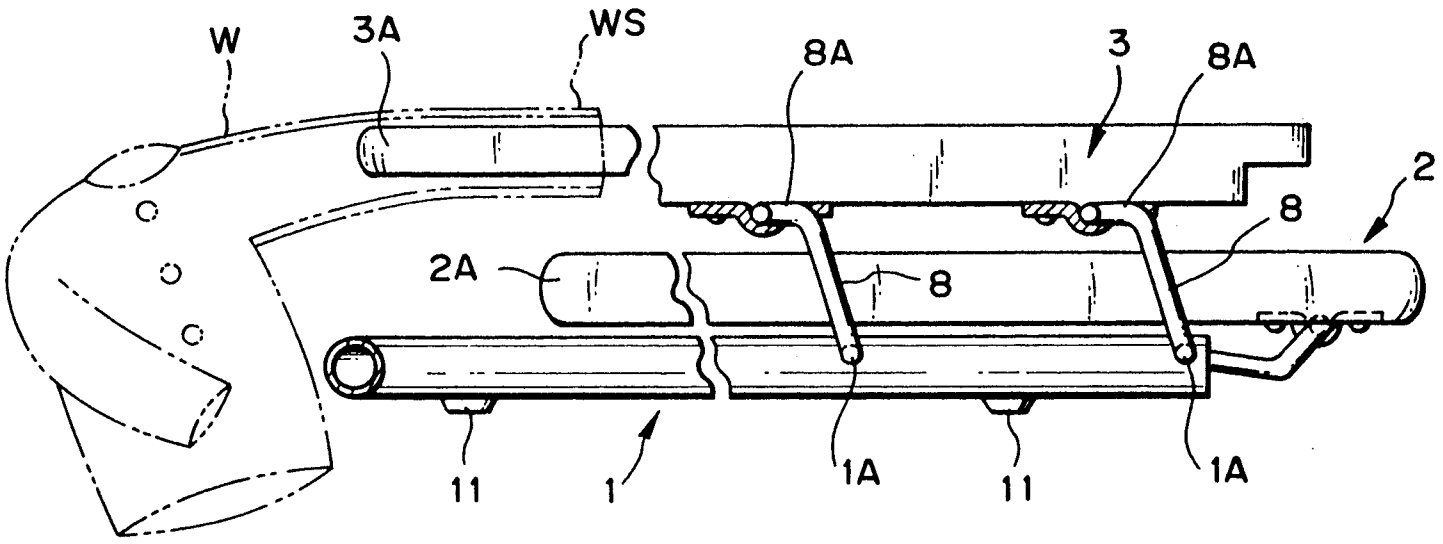
FIG. 5 is a side view showing the manner in which a second ironing board is erected and a third ironing board is collapsed.

FIG. 5 is a side view showing the second ironing board 3 in the extended state and the first ironing board 2 is the collapsed state. When the second ironing board 3 is moved leftward in FIG. 4 in order to place it in the extended state of FIG. 5, the second ironing board 3 starts moving in the direction of arrow C until the step portions 8A of the small support rods 8 eventually support the bottom face of the second ironing board. As a result, the second ironing board 3 attains the extended state.

In order to place the second ironing board 3 in the collapsed state, it will suffice to move it in the direction opposite that mentioned above.

When the sectional-type ironing board described above is used, it is placed in the collapsed state shown in FIG. 1 or both the first and second ironing boards 2, 3 are placed in the extended state to form the joint ironing board. This enables a comparatively broad portion of a garment, such as the back thereof, to be ironed using the first and second ironing boards in combination.

Next, in a case where a cylindrical body having a small diameter such as a sleeve or child's trousers is to be ironed, only the second ironing board 3 is placed in the extended state, as depicted in FIG. 5, a tip portion 3A of the second ironing board 3 is inserted into a sleeve opening WS or the like, and the sleeve is flattened out on the second ironing board 3 and then ironed. When ironing of this portion is completed, the sleeve or trouser leg, etc. is turned about the longitudinal axis of the second ironing board 3 so that the garment can be ironed in successive fashion in an efficient manner.

In a case where a garment shoulder portion or the like is to be ironed, the second ironing board 3 is returned to the collapsed state, the first ironing board 2 is placed in the extended state, the shoulder portion is fitted over the end 2A of this ironing board and this portion is ironed.

Figure 6:
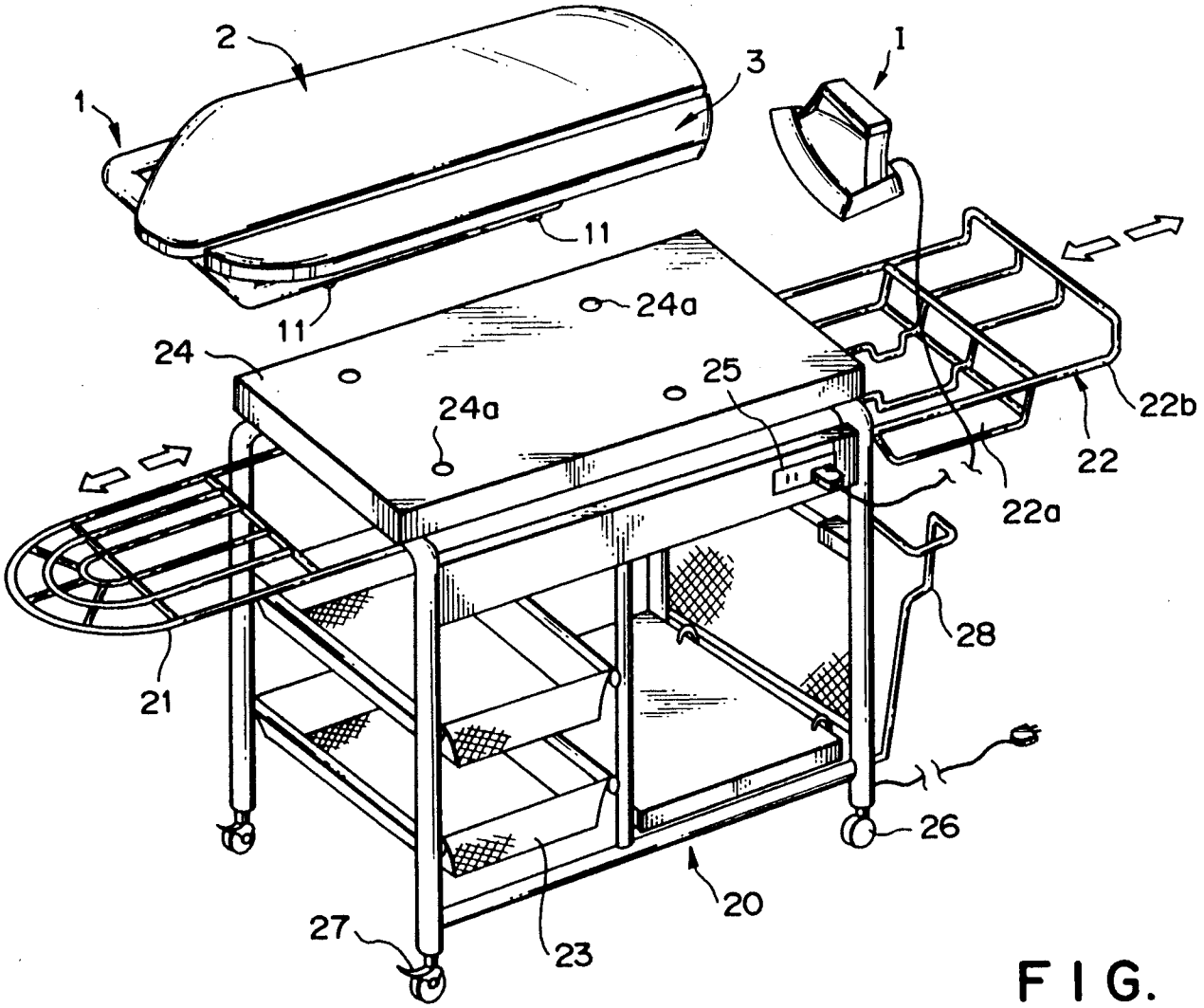
FIG. 6 is an external perspective view showing an ironing table.

FIG. 6 is an external perspective view showing an ironing table 20. Here the above-described ironing board is shown placed upon the ironing table 20 in a freely detachable manner.

In FIG. 6, the sectional-type ironing board is used as set forth above but it must be placed at a suitable height in view of operating ease. The ironing table 20 places the sectional-type ironing board at the proper height and is integrally provided with a garment rest, an iron rest and other parts necessary for an ironing operation. The ironing table 20 can also be used as a simple table for purposes other than ironing.

The ironing table 20 used in this manner can be employed also as a so-called table wagon or cart capable of being moved about freely for use in a kitchen or the like. A plate 24 is secured to the upper portion of the ironing table 20, and the plate 24 is provided at suitable locations with the holes 24*a* with bottom portion in which the aforementioned rubber legs 11 are set. And by turning plate 24 up side down, the holes 24*a* disappear, thus making other use of plate 4 more convenient. The sectional-type ironing board is capable of being freely mounted on and unmounted from the ironing table 20. When not in use, the separating-type ironing board is stored upright in an accommodating portion 28 at the side of the table.

The right side of the lower portion of the plate 24 of ironing table 20 is provided with an iron rest 22 made of metal pipes. The iron rest 22 can be pulled out only so far as a rest portion 22*b* or as far as a recessed portion 22*a*, which are defined by stoppers (not shown). The left side of the lower portion of plate 24 is provided with a garment rest 21. The garment rest 21 can be pulled outward in the direction of the arrow in FIG. 6 and set as an ironing board, or the garment rest 21 can be pushed inward in the direction of the arrow so as to be accommodated within the table.

The recessed portion 22*a* of the iron rest 22 is for storing an iron I. After use, the iron I, while still hot, is placed on the recessed portion 22*a*, whereupon the iron rest 22 is pushed inwardly in the direction of the arrow to store the iron within the table 20. This prevents accidents by prevening a child from touching the hot iron I. Accordingly, the iron rest 22 is pulled out only so far as the rest portion 22*b* when ironing is performed.

The garment rest 21 is for supporting a garment to undergo ironing. Laundry baskets 23 are provided inside the ironing table 20 and can be taken in and out at will. The laundry baskets 23 are for receiving garments to be ironed and garments already ironed.

The ironing table 20 is integrally constructed by welding together pipes bent into the form shown in FIG. 6, by way of example. Freely moving casters 26 are fitted into the pipes and fixed, and some of the casters 26 are provided with stoppers 27 which, by being properly manipulated, are capable of preventing movement of the ironing table 20.

The upper edge portion of the ironing table 20 is provided with a power-supply outlet 25 which supplies electric power to the iron I.

Ironing can be carried out easily and efficiently using the ironing table 20 and sectional-type ironing board described above. In addition, by storing the sectional-type ironing board in the accommodating portion 28 and pushing the garment rest 21 and iron rest 22 into the ironing table 21 so as to be accommodated beneath the plate 24 of the ironing table, the latter can be used for other purposes, with the plate 24 serving as a simple table or the like.

Figure 7:
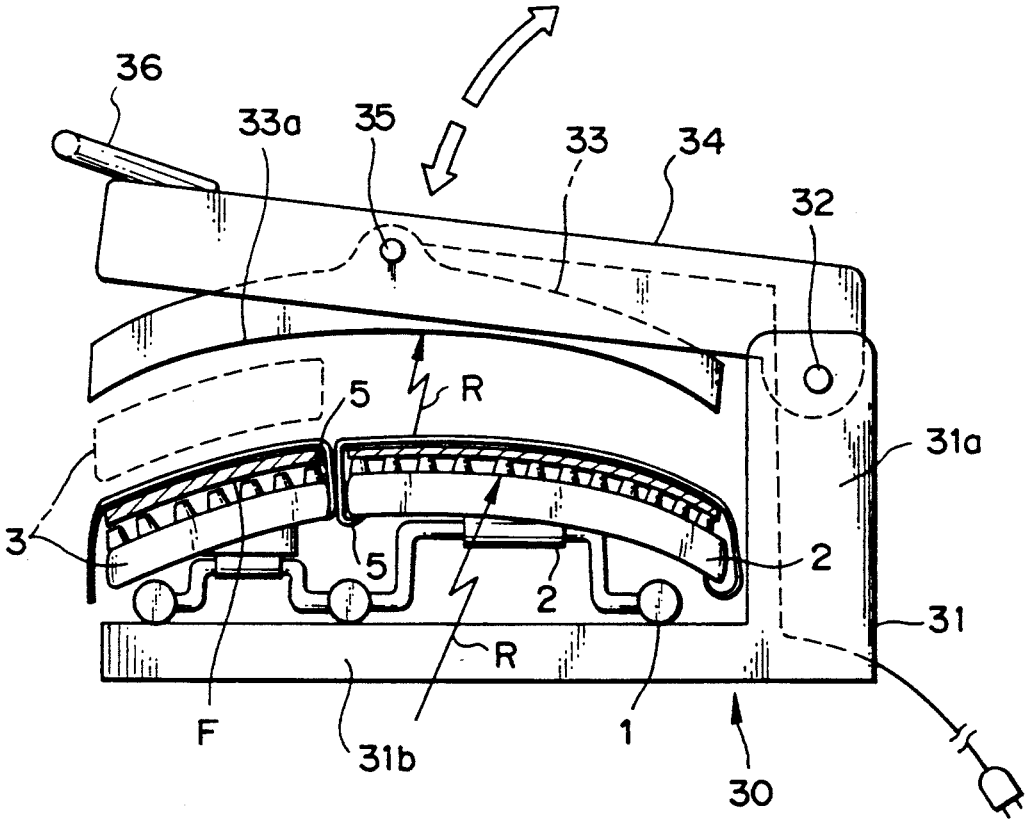
FIG. 7 is a side view of a pressing apparatus.

FIG. 7 is a side view illustrating a pressing apparatus 30, in which the above-described sectional-type ironing board is shown used as a pressing board.

In FIG. 7, the pressing apparatus 30 has a base 31 which includes a support portion 31*a* the upper end of which is provided with a fulcrum 32. The base 31 includes a rest portion 31*b* on which the above-described sectional-type ironing board is provided either detachably or as an integral part. A fulcrum 35 is provided at the approximate central portion of a support body 34 one end of which is pivotally supported by the fulcrum 32. A pressing head 33 is provided so as to turn freely about the fulcrum 35. The support body 34 is provided with biasing means, not shown, for holding the support body 34 in the state illustrated in FIG. 7.

The other end of the support body 34 has a handle 36 which, by being grasped and moved downwardly, moves the heater 33 toward the pressing board.

The pressing head 33 is formed to have a female curved surface 33*a* along the joint ironing board of the sectional-type ironing board. This assures that a garment will not move when the heater 33 is moved relative to the ironing board, and acts to spread the garment from the central portion to the edge portion thereof, thereby preventing the garment from wrinkling.

Furthermore, in a case where the second ironing board 3 translated as set forth above is moved to the position indicated by the dashed lines, a portion of the pressing head 33 is brought into contact with the second ironing board 3. This makes it possible to use the second ironing board 3 for cylindrically shaped portions of garments such as sleeves or a child's trousers.

In a case where the sectional-type ironing board is designed especially for the pressing apparatus 30, the base 1 is formed as an integral part of the base 31 as a matter of course.

In the example described above, the aforesaid sectional-type ironing board is such that only one set of large and small ironing boards or a single pressing board is provided so as to be movable up and down relative to a base. However, it is permissible to provide two or more ironing boards on a common base.

Figure 8:
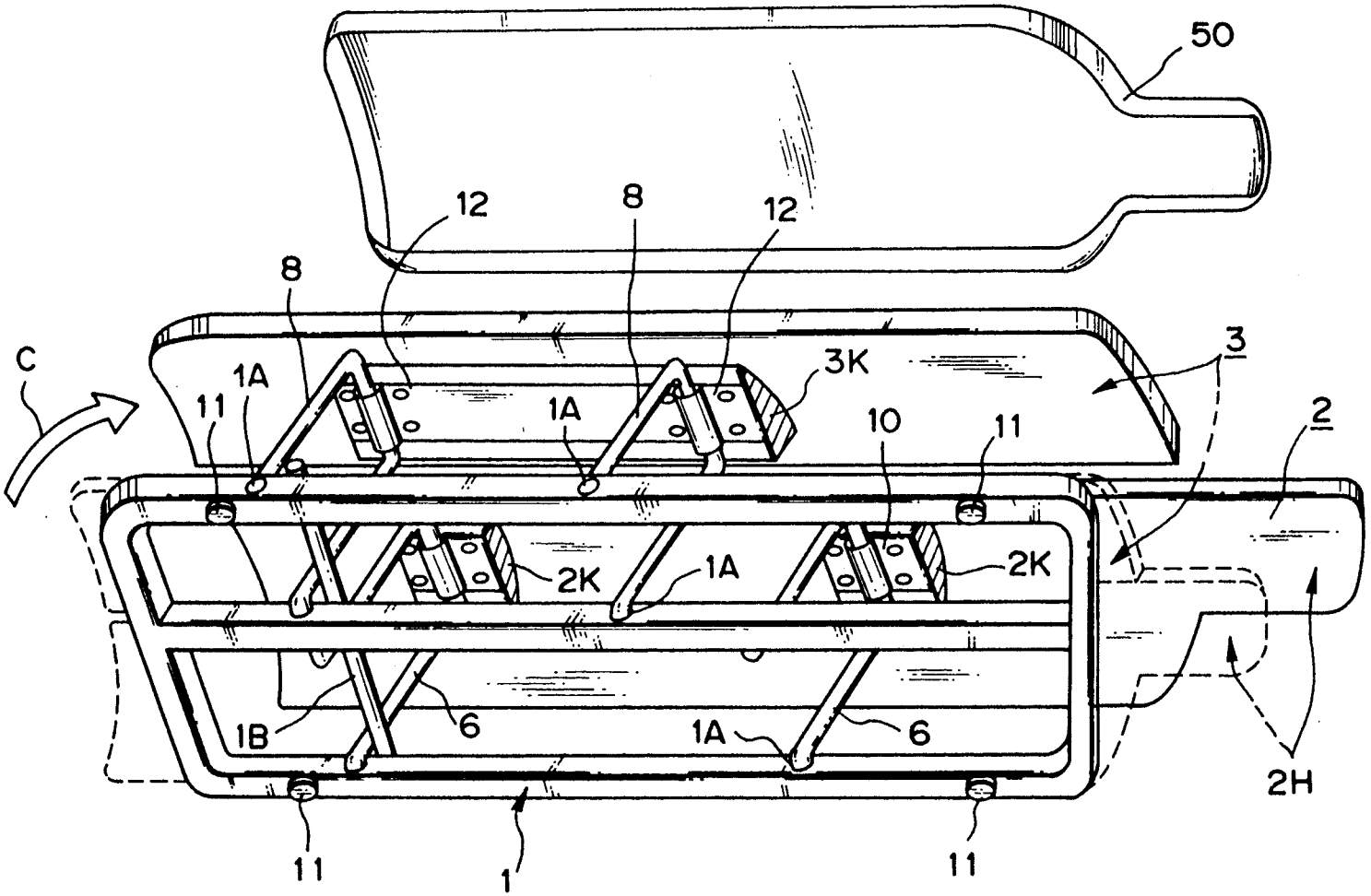
FIG. 8 is a perspective view seen from the bottom illustrating a sectional type ironing board according to the second embodiment of the present invention.

Finally, FIG. 8 is perspective view of the second embodiment of the present invention, viewed from the bottom of the base 1. As shown in FIG. 8, the construction of the sectional-type ironing board is almost the same as that of already mentioned one, therefore only different portions now will be described.

Base 1 is made a steel pipe having a square cross section and is welded to form closed body. A cross bar 1B for supporting one of small support rods 8, and large support rod 6 is welded on the upper surface of the base 1. The first ironing board 2 incorporates supporting portions 2K for mounting a pair of bracket 10 which support large support the rods 6; and the second ironing board 3 incorporates supporting portion 3K for mounting bracket 12 which supports small support rods 8.

The first ironing board 2 has a head portion 2H as shown in FIG. 8.

A common cover 50 easily detachable from the ironing surface of the boards is also provided.

In this structure, one of small support rods 8 and large support rods 6 comes into abutting contact with a cross bar 1B when the extended state is established. And a common cover 50 is attached when a common working surface is established.

Thus, as described above, the sectional-type ironing board according to the present invention can be used for ironing cylindrical garment portions having a small diameter, such as sleeves or a child's trousers, and for ironing the shoulder portions of garments as well. In addition, the sectional-type ironing board of the invention reduces the force needed for manipulating an iron.

In addition to the above effects, the sectional-type ironing board of the invention allows steam to act upon a garment in an adequate manner.

Furthermore, the sectional-type ironing board of the invention is light in weight and easy to handle.

Further, the invention provides an ironing table in which the sectional-type ironing board can be freely mounted on and detached from a plate so that the table can be used for other purposes. The ironing table is capable of improving the ironing operation.

The invention provides also a pressing apparatus in which a garment placed upon the ironing board will not move when contacted by an iron, and in which the garment can be stretched evenly and pressed uniformly when contacted by a heater. The pressing apparatus can be used to press cylindrical garment portions having a small diameter, such as sleeves or a child's trousers.

As many different embodiments of the present invention can be made without departing from the spirit and scope thereof, it is to be understood that the invention is not limited to the specific embodiments thereof except as defined in the appended claims.

What is claimed is:

1. A sectional-type ironing board comprising:

a first ironing board having a longitudinal direction, a second ironing board having a longitudinal direction, said second ironing board having a working surface smaller than a working surface of said first ironing board;

said first and second ironing boards being oriented in the same direction;

said first ironing board and said second ironing board having side edge portions that are mutually adjacent;

said first ironing board and said second ironing board being independently movable to a collapsed state and an extended state relative to a common base; and wherein:

said first and second ironing boards are further movable to at least one of said collapsed state and said extended state to form a joint working surface in a common plane; and said joint working surface having a curved surface sloping downwardly away from said side edge portions along the longitudinal direction of said first and second ironing boards.

2. The ironing board according to claim 1, wherein:

said first ironing board and said second ironing board include a parallel link mechanism for supporting said first ironing board and said second ironing board so as to be movable in both a direction parallel to said common base and in an up and down direction relative to said base;

said parallel link mechanism including a pair of support rods each having a step portion which comes into contact with a bottom face of said first ironing board and of said second ironing board;

said parallel link mechanism maintaining the extended state by a holding member secured to said common base, and said step portion and said bottom face coming into contact in said extended state.

3. The ironing board according to claim 1, wherein said first ironing board and said second ironing board are each provided with a number of projections on said working surface thereof.

4. The ironing board according to claim 1, wherein said first ironing board and said second ironing board are each provided with a number of grooves in said working surface thereof.

5. The ironing board according to claim 1, wherein said first ironing board and said second ironing board respectively comprise a resin material.

6. The ironing board according to claim 1, wherein:

said first ironing board and said second ironing board are each provided with a number of projections on said working surface thereof, each of said first and second ironing boards being formed by blow molding of a resin material.

7. The ironing board according to claim 1, wherein said joint working surface formed by said first ironing board has a head portion.

8. The ironing board according to claim 1, wherein a common cover is detachably provided on said first ironing board and said second ironing board.

9. The ironing board according to claim 1, wherein said common base is integrally formed of tubular members.

10. The ironing board according to claim 1, wherein said common base has a bottom portion including a rest part having a rest portion on which at least one article is placeable.

11. An ironing table used in combination with the sectional-type ironing board of claim 1, said ironing table comprising:

a cart provided for the ironing table; and a plate having a means for receiving and fixing a rest portion for supporting said sectional-type ironing board.

12. The ironing table according to claim 11, further comprising:

an iron rest on which an iron is placeable, and a garment rest on which at least one garment is placeable;

said iron rest and said garment rest being provided on a side face of said cart.

13. The ironing table according to claim 11, further comprising an accommodating portion positioned on a lower part of a side face of said cart for accommodating said sectional-type ironing board in a storable state.

14. The ironing table according to claim 11, wherein a laundry basket is positionable inside said cart and is removable from a front side of said cart.

15. The ironing table according to claim 11, wherein said cast is provided with a power-supply outlet that is connectable to a power supply.

16. The ironing table according to claim 11, wherein a bottom portion of said cart is provided with a plurality of casters, each caster having a caster movement stopping means.

17. A pressing apparatus comprising:

a pressing head having a curved working surface which matches a curved joint working surface of a sectional-type pressing buck that is removable and useable as a sectional-type ironing board when removed from said pressing apparatus; and a base portion for supporting said pressing head and for placing said pressing head in at least one of a state in contact with the pressing buck and a state spaced away from said pressing buck.

18. The pressing apparatus according to claim 17, wherein said sectional-type ironing board comprises a first ironing board and a second ironing board, each respectively comprise a blow molded resin material.

19. A pressing apparatus according to claim 17, wherein the sectional-type ironing board includes:

a first ironing board and a second ironing board;

said first and second ironing boards including a parallel link mechanism for supporting said first and second ironing boards such that said first and second ironing boards are both movable in a direction parallel to said base as well as in an up and down direction relative to said base;

said parallel link mechanism including a pair of support rods each having a step portion which comes in contact with a bottom face of the first ironing board and of the second ironing board;

said parallel link mechanism maintaining an extended state of the first and second ironing boards;

said parallel link mechanism including a holding member secured to the base for maintaining the first and second ironing boards in the extended state; and said step portion and said bottom face of said first ironing board coming into contact when said pressing apparatus is in said extended state.

20. The pressing apparatus according to claim 17, wherein said sectional-type ironing board includes:

a first ironing board and a second ironing board;

said first and second ironing boards each including a number of projections on a working surface thereof.

* * * * *

UNITED STATES PATENT AND TRADEMARK OFFICE

CERTIFICATE OF CORRECTION

PATENT NO. : 5,161,316

DATED : November 10, 1992

INVENTOR(S) : SAITO, Sorai

It is certified that error appears in the above-identified patent and that said Letters Patent is hereby corrected as shown below:

Column 1, line 8, after "ironing", insert --board--.

Column 2, line 47, change "presser" to --pressing--.

Column 7, line 15, change "support large support the rods" to read --support the large support rods--.

Column 9, line 14 (claim 15), change "cast" to --cart--.

Signed and Sealed this

Ninth Day of November, 1993

Bruce Lehman

*Attest:*

BRUCE LEHMAN

*Attesting Officer*

*Commissioner of Patents and Trademarks*